US008079465B2

(12) United States Patent
Edwards et al.

(10) Patent No.: US 8,079,465 B2
(45) Date of Patent: Dec. 20, 2011

(54) SAFETY PACKAGING

(75) Inventors: Karl Edwards, Gwent (GB); David Phillip Jones, Gwent (GB)

(73) Assignee: BAE Systems plc, London (GB)

( * ) Notice: Subject to any disclaimer, the term of this patent is extended or adjusted under 35 U.S.C. 154(b) by 360 days.

(21) Appl. No.: 11/632,113

(22) PCT Filed: Jul. 13, 2005

(86) PCT No.: PCT/GB2005/050110

§ 371 (c)(1),
(2), (4) Date: Jan. 11, 2007

(87) PCT Pub. No.: WO2006/021816

PCT Pub. Date: Mar. 2, 2006

(65) Prior Publication Data

US 2008/0053843 A1 Mar. 6, 2008

(30) Foreign Application Priority Data

Jul. 14, 2004 (EP) ..... 04254205
Jul. 14, 2004 (GB) ..... 0415714.5

(51) Int. Cl.
*F42B 39/00* (2006.01)
*B65D 85/00* (2006.01)

(52) U.S. Cl. ..... 206/3; 206/317

(58) Field of Classification Search ..... 206/3, 317; 102/293; 224/196, 199, 223, 234; 42/87
See application file for complete search history.

(56) References Cited

U.S. PATENT DOCUMENTS

| | | | | |
|---|---|---|---|---|
| 2,750,028 | A * | 6/1956 | Bode et al. | 206/3 |
| 3,631,969 | A * | 1/1972 | Lacoste et al. | 206/3 |
| 3,757,933 | A * | 9/1973 | Banta | 206/3 |
| 3,765,298 | A | 10/1973 | Wallberg | |
| 4,286,708 | A * | 9/1981 | Porzel | 206/3 |
| 5,158,173 | A | 10/1992 | Halsey et al. | |
| 5,385,764 | A * | 1/1995 | Andersen et al. | 428/34.4 |
| 5,759,649 | A * | 6/1998 | Dinter et al. | 428/35.3 |
| 7,025,000 | B1 * | 4/2006 | Wong et al. | 102/481 |
| 7,520,223 | B2 * | 4/2009 | Sharpe et al. | 102/303 |
| 2005/0113473 | A1 * | 5/2005 | Wada | 521/143 |
| 2005/0188825 | A1 * | 9/2005 | Sharpe et al. | 86/50 |

FOREIGN PATENT DOCUMENTS

| | | | |
|---|---|---|---|
| DE | 2 040 475 | | 8/1970 |
| DE | 102 22 344 | C1 | 5/2002 |
| EP | 0 061 255 | A2 | 9/1982 |
| FR | 2600999 | A1 | 8/1988 |
| GB | 2 361 985 | A | 11/2001 |
| WO | WO 86/04562 | | 8/1986 |
| WO | WO 98/12496 | | 3/1998 |

* cited by examiner

*Primary Examiner* — J. Gregory Pickett
*Assistant Examiner* — Ernesto Grano
(74) *Attorney, Agent, or Firm* — Crowell & Moring LLP

(57) ABSTRACT

A package for the safe storage and transportation of munitions comprising at least one insert provided with a recess to receive each munition separately such that in use the munitions are separated by the insert material and one or more labyrinthine paths exist between the munitions. The moulds may be made of blast mitigating material for the effective dissipation of energy on unintentional detonation of a munition.

14 Claims, 1 Drawing Sheet

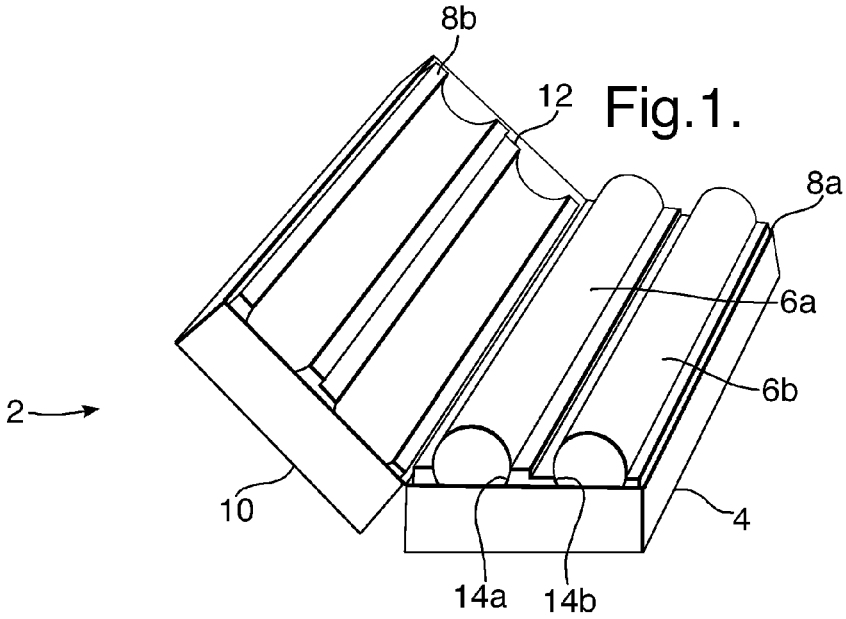
Fig.1.
Fig.2.
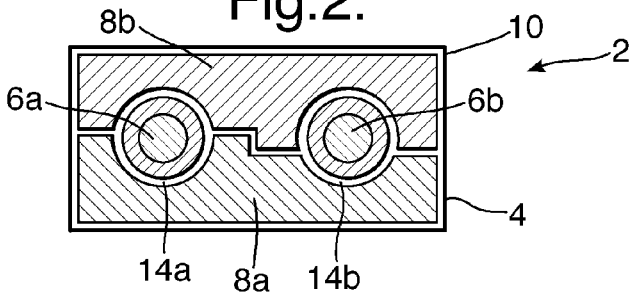
Fig.3a.
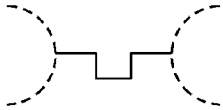
Fig.3b.
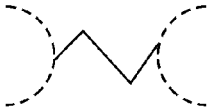
Fig.3c.
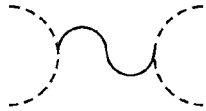
Fig.4.
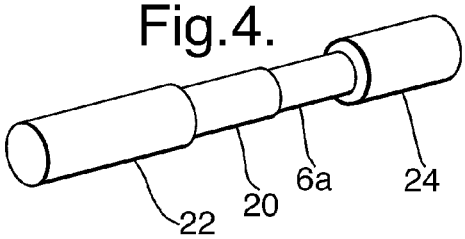
Fig.5.
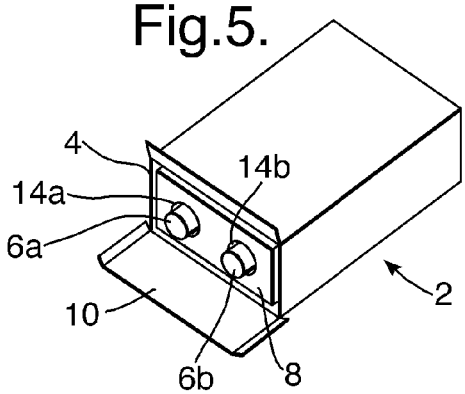

SAFETY PACKAGING

The present invention relates to safety packaging and particularly to packaging for the safe storage and transportation of munitions.

Munitions are inherently hazardous by virtue of the stored energy and destructive power which explosives are designed to release onto a target. Whilst munitions incorporate design features such as fusing systems and safety trains to ensure that they remain safe in the planned service environment, they are susceptible to accidental and combat stimuli such as heat, shock and impact. When subjected to an unplanned stimulus such as the detonation of an adjacent munition or the impact of a bullet or fragment, a munition may detonate unintentionally, with potentially devastating consequences.

Munitions are commonly stored in containers which may be stacked together. An unintentional detonation of one munition in a stack can lead to other munitions in the same container, as well as those in other containers, detonating, giving rise to a large and unintentional explosion.

Munitions are classified according to the damage which can result from their accidental explosion and their susceptibility to accidental detonation. Munitions which incorporate risk-reducing features to meet certain safety requirements are known as Insensitive Munitions (IM). One known risk-reducing feature is the use of modern energetic materials, for example Plastic Bonded Explosives (PBX). These materials are less sensitive to accidental stimuli than traditional TNT-based explosives, and therefore minimize the risk of unintentional detonation of the munitions.

Specialized packaging has also been used to protect munitions by attenuating the stimulus before it impacts a munition and to reduce the damage caused by detonation of the munition. Currently, packages exist for single munitions or for multiple munitions. There is no current packaging, however, for multiple munitions which meets IM compliance requirements.

Accordingly, the present invention provides a package for more than one munition comprising at least one insert provided with recesses to receive each munition separately, such that in use the munitions are separated by the insert material and one or more labyrinthine or tortuous, paths exist between the munitions.

When a munition detonates, fragments and/or gas from the detonation can cause an adjacent munition to function unintentionally. The provision of such a package with one or more labyrinthine paths between munitions in the package provides a package with no direct blast path between the munitions and the voids within the material which form the labyrinthine paths provide the desired cushioning effect. A blast wave from the detonation of a munition consists of, in order of speed of travel in free space, radiation, a shock wave, gas and shrapnel. The absence of a direct, straight line path between the munitions reduces the transmission of radiation, gas and shrapnel and attenuates the transmission of the shock wave, so protecting munitions within the container from the stimulus of an unplanned detonation of another munition within the container.

The package preferably comprises at least two inserts which mate together such that in use a labyrinthine path exists between the munitions where the inserts mate.

A package with a joint line providing a labyrinthine path between munitions in the package provides no direct blast path between the munitions and also enables munitions to be loaded easily into the package.

Advantageously, the labyrinthine path where the inserts mate has rotational symmetry about an axis running roughly parallel to the munitions. This makes it possible for each of the two inserts forming a package to be identical and therefore manufactured cost effectively from the same mould tool. The inserts are then interchangeable and incorrect positioning of the lid is prevented by the two inserts not mating properly unless in the correct orientation.

The labyrinthine path where the inserts mate may have a stepped profile. This is advantageous because the vertical edge of packaging perpendicular to the blast wave is more effective at reducing the effects of a blast wave.

The or each insert is preferably formed of blast mitigating material. The use of blast mitigating material reduces the degree of sympathetic reaction of munitions as well as protecting the munitions from external stimuli by providing thermal and environmental insulation.

The blast mitigating material preferably contains carbon black for the purpose of allowing static charges to migrate and dissipate. This minimizes the risk of static build-up within the package.

The blast mitigating material may be expanded polypropylene (EPP), glass reinforced plastic (GRP), high density polyethylene (HDPE), Hydroleca (Hydroleca is a trademark of William Sinclair Holdings pic) or a laminate. These materials have good blast mitigation properties, substantially reducing the effects of blast waves.

The thickness of insert material between the recesses and separating munitions in the package should be at least 50 mm between munitions in the package. This further reduces the risk of sympathetic detonation.

Optionally, each recess has a liner, which may be formed of fibreboard. This layered packaging reduces the effect of a blast.

The thickness of insert material between the lined recesses and separating munitions in the package should be at least 35 mm between munitions in the package. This further reduces the risk of sympathetic detonation.

According to a second aspect of the invention, there is provided a porous clay aggregate material for use as impact mitigation material for use in the packaging of munitions.

It has been found that clay aggregate material, such as Hydroleca which has a honeycomb structure, has good thermal and environmental insulation properties and substantially reduces the effects of blast waves.

The invention will now be described by way of example and with reference to the accompanying drawings, in which:

FIG. 1 shows an embodiment of a package in accordance with the invention;

FIG. 2 is a schematic cross-section view of the package shown in FIG. 1;

FIGS. 3*a, b* and *c* illustrate possible forms of joint line;

FIG. 4 shows a part of a package suitable for use with the package of FIG. 1, and FIG. 5 shows another embodiment of a package in accordance with the invention.

FIG. 1 shows a safety package 2 comprising a steel container 4 with a hinged and/or removable lid 10. The container 4 and lid 10 hold inserts 8*a* and 8*b*, formed from blast mitigating material, for example expanded polypropylene (EPP). Two PBX munitions 6*a* and 6*b* are held in recesses 14*a* and 14*b* provided in the inserts 8*a* and 8*b*. The inserts 8*a* and 8*b* are configured, when the lid 10 is closed on the container 4 so that the two inserts mate, to substantially encase the munitions 6*a* and 6*b*. The inserts are formed such that a joint line of the two inserts 8*a* and 8*b* exists between the munitions. This enables the munitions 6*a* and 6*b* to be easily loaded into the recesses 14*a* and 14*b*. As can be seen more clearly in FIG. 2, the joint line is such that a labyrinthine path 12 exists between the recesses 14*a* and 14*b* holding the munitions. This ensures there is no direct blast path between the munitions 6*a* and 6*b*. In FIGS. 1 and 2 the path 12 is shown as having a stepped profile which is rotationally symmetric when seen in cross-section, as in the Figures; however, it will be understood by the skilled person that it may take other labyrinthine forms as shown in FIGS. 3*a*, 3*b* and 3*c*, for example a non-rotationally symmetric stepped profile or a sawtooth or sinusoidal waveform, or any combination of such arrangements. The inserts 8*a* and 8*b* shown in FIGS. 1 and 2 have the same shape and therefore can be made using the same mould tool and are interchangeable providing ease of assembly of the safety package. This also prevents the lid being placed on the container incorrectly, as the inserts will not mate when in the incorrect orientation relative to each other.

On detonation of one of the munitions 6*a* and 6*b*, an energetic pulse (blast wave) blows that munition apart. The blast wave emanates from the detonated munition, causing shrapnel to be ejected in all directions. Packaging 8*a* and 8*b* surrounding the detonated munition is destroyed. The use of blast mitigating material as sacrificial packaging enables as much energy as possible to be transferred from the blast wave and dissipated; the energy of the blast is absorbed by the blast mitigating material, with bonds within the blast mitigating material being broken and the material torn apart. The transferral of energy from the blast wave to the blast mitigating material reduces the energy transferred to the other munition in the container. The transmission of the components of a blast wave are attenuated or prevented from travelling from a detonated munition to another munition in the package by the labyrinthine path 12. In this way, sympathetic detonation of the explosive or fuse in that other munition is prevented and the damage caused by accidental detonation of a munition during transportation or storage is reduced.

Initially, the blast mitigating material undergoes elastic deformation, contributing considerably to damping the propagation of the blast wave. Material with good energy absorption properties, such as EPP, is suitable for use as blast mitigating material. EPP has the additional advantages of being easy to manufacture and mould, is lightweight and is recyclable. Alternatively, glass reinforced plastic (GRP) or high density polyethylene (HDPE) can be used. Typically such blast mitigating material has low thermal conductivity, good thermal stability (i.e. maintains dimensions at temperatures up to 100° C.) and resists frictional and corrosive wear. The discharge of static electricity is undesirable and can lead to unintentional detonation of a munition or can give personnel an electric shock. It is therefore important to avoid static build-up. This is particularly important when the package is in use in extreme climatic conditions. The use of blast mitigating material with a relatively high carbon content minimizes the risk of static build-up within the package.

It is preferable for the distance between munitions 6*a* and 6*b* in the package 2 to be greater than 50 mm. This provides a thickness of conventional blast mitigating material between the munitions 6*a* and 6*b* sufficient to protect one from unintentional detonation of the other.

Each munition may be encased in a spirally-wound fibreboard tube before being placed in the safety package 2. The extra layer of packaging is advantageous as it provides further protection for the munitions by reducing the blast effect. For ease of loading, the tubes are sleeved as shown in FIG. 4. A munition 6*a* is inserted into one part 22 of the tube. A narrow sleeve 20 slides inside a second part 24 of the tube providing a frictional fastening means for holding the two parts 22 and 24 of the tube together. When such an additional packaging layer is used, it is preferable for the insert material thickness between the recesses and separating the munitions to be greater than 35 mm.

FIG. 5 shows, according to an alternative embodiment of the invention, a safety package 2 comprising a plywood container 26. The container 26 holds a unitary insert 8 made of a porous impact mitigating material, for example Hydroleca.

Recesses 14*a* and 14*b* are provided in the insert 8 such that two munitions 6*a* and 6*b* can be slid into the recesses 14*a* and 14*b* via an end of the insert 8.

The container 26 has a lid 10 for securing the insert 8 and munitions 6*a* and 6*b* within the safety package 2 during transport.

Hydroleca is a porous expanded clay aggregate, formed by expansion of clay at high temperatures, and has a honeycomb structure. The provision of an end-accessible safety package ensures there is no direct blast path between the munitions 6*a* and 6*b*. The reticulated structure of Hydroleca provides labyrinthine paths throughout the insert 8; the package 2 is thereby provided with at least one labyrinthine path between the munitions 6*a* and 6*b*. Such a honeycomb structure is an effective blast or impact mitigating material, the transmission of radiation, gas and shrapnel and the blast shock wave is attenuated by the air pockets within the honeycomb cells.

Having now described various embodiments of the invention, numerous modifications will become apparent to the skilled person. For example, a layered laminate, such as a composite of alumina and plywood, may be used as blast mitigating material. Also, rather than or in addition to the tubes shown in FIG. 4, the recesses 14*a* and 14*b* in the moulds may be lined with an additional layer of packaging material, such as fibreboard. The inserts may be formed by, for example, moulding or tooling.

The invention claimed is:

1. A package for a plurality of munitions, said package comprising at least two inserts provided with recesses to receive each munition separately; wherein:

the at least two inserts mate together such that in use, the munitions are separated by the two inserts, and at least one labyrinthine path exists between the munitions where the at least two inserts mate, wherein the labyrinthine path is uninterrupted along an entire length of the package between the munitions so that when one of said munitions detonates there is no direct blast path between the munitions for transmission of blast wave components after the detonation;

the at least two inserts are made of a blast mitigating material that is capable of undergoing elastic deformation; and wherein the labyrinthine path has a rotational symmetry.

2. The package according to claim 1, wherein the labyrinthine path has a stepped profile.

3. The package according to claim 1, wherein each insert is made of porous material.

4. The package according to claim 1, wherein the blast mitigating material contains carbon black for the purpose of allowing static charges to migrate and dissipate.

5. The package according to claim 1, wherein the blast mitigating material is EPP.

6. The package according to claim 1, wherein the thickness of insert material between the recesses and separating the munitions is greater than 50 mm.

7. The package according to claim 1, wherein each recess has a liner.

8. The package according to claim 7, wherein the liner is formed of fibreboard.

9. The package according to claim 7, wherein the thickness of insert material between the recesses and separating the munitions is greater than 35 mm.

10. The package according to claim 1, wherein the blast mitigating material is clay aggregate material.

11. A package for a plurality of munitions, said package comprising first and second inserts, each of which is provided with a plurality of recesses to receive a corresponding plurality munitions; wherein:

the first and second inserts mate together such that in use, the munitions are separated by the mated first and second inserts, and such that, along an entire longitudinal extent, which is parallel to a longest dimension of the recesses, of an area where the first and second inserts mate together between adjacent munitions, only an uninterrupted labyrinthine path exists between the adjacent munitions so that when one of the adjacent munitions detonates there is no direct blast path between the adjacent munitions for transmission of blast wave components after detonation, wherein the labyrinthine path is rotationally symmetric about a longitudinal axis of the package;

the at least two inserts are made of a blast mitigating material that is capable of undergoing elastic deformation.

12. The package according to claim 11, wherein the blast mitigating material is clay aggregate material.

13. A package for a plurality of munitions, said package comprising first and second inserts provided with a plurality of recesses to receive each munition separately; wherein:

the first and second inserts mate together such that in use, the munitions are separated by the inserts, and a labyrinthine path exists in an area between adjacent munitions where the first and second inserts mate, at the point of detonation;

the labyrinthine path extends longitudinally for an entire length of the recesses which house said adjacent munitions, is uninterrupted for the entire length of the recesses and has a transverse cross section that is rotationally symmetric so that when one of the adjacent munitions detonates there is no direct blast path between the adjacent munitions for transmission of blast wave components after detonation; and the at least two inserts are made of a blast mitigating material that is capable of undergoing elastic deformation.

14. The package according to claim 13, wherein the blast mitigating material is clay aggregate material.

* * * * *